US008746766B2

(12) United States Patent
Lewkoski

(10) Patent No.: US 8,746,766 B2
(45) Date of Patent: Jun. 10, 2014

(54) HOOK ASSEMBLY

(76) Inventor: Randy Lewkoski, Shiner, TX (US)

( * ) Notice: Subject to any disclaimer, the term of this patent is extended or adjusted under 35 U.S.C. 154(b) by 77 days.

(21) Appl. No.: 13/490,599

(22) Filed: Jun. 7, 2012

(65) Prior Publication Data

US 2013/0328335 A1 Dec. 12, 2013

(51) Int. Cl.
*B66C 1/34* (2006.01)

(52) U.S. Cl.
USPC ..... 294/33; 294/82.31; 294/82.34; 294/82.19

(58) Field of Classification Search
USPC ..... 294/82.33, 82.2, 82.31, 82.34, 82.19, 294/82.21, 66.1
See application file for complete search history.

(56) References Cited

U.S. PATENT DOCUMENTS

| | | | | |
|---|---|---|---|---|
| 227,221 | A | | 5/1880 | Dillaby |
| 457,524 | A | | 8/1891 | Bucknam |
| 501,875 | A | | 7/1893 | Cutter |
| 644,699 | A | | 3/1900 | Woodford |
| 894,345 | A | | 7/1908 | Raymond |
| 1,144,099 | A | | 6/1915 | Black |
| 1,239,301 | A | | 9/1917 | Pearson |
| 1,333,511 | A | | 3/1920 | Small |
| 1,390,023 | A | | 9/1921 | Coon |
| 1,457,648 | A | | 6/1923 | Bailey |
| 1,505,051 | A | | 8/1924 | Lindgren |
| 1,533,995 | A | | 4/1925 | Lang |
| 1,554,303 | A | | 9/1925 | Smith |
| 1,576,197 | A | | 3/1926 | Kuffel et al. |
| 1,582,345 | A | | 4/1926 | O'Bannon |
| 1,682,617 | A | | 8/1928 | Jensen et al. |
| 1,790,056 | A | | 1/1931 | Moody |
| 1,794,694 | A | | 3/1931 | Jensen et al. |
| 1,879,167 | A | | 9/1932 | Freysinger |
| 1,949,608 | A | | 3/1934 | Johnson |
| 1,956,786 | A | | 5/1934 | Bemis |
| 2,027,376 | A | | 1/1936 | Grau |
| 2,328,341 | A | | 8/1943 | Higgins et al. |
| 2,341,876 | A | | 2/1944 | Masterson |
| 2,705,357 | A | | 4/1955 | Davick |
| 2,814,522 | A | | 11/1957 | Palmer et al. |
| 2,864,644 | A | | 12/1958 | Marryatt |
| 2,866,247 | A | | 12/1958 | Clegg |
| 2,905,997 | A | | 9/1959 | Ramskill |
| 3,038,753 | A | | 6/1962 | Seager |
| 3,126,604 | A | | 3/1964 | Smith |
| 3,179,461 | A | * | 4/1965 | Rose et al. ..... 294/82.33 |
| 3,194,598 | A | | 7/1965 | Goldfuss |
| 3,208,787 | A | * | 9/1965 | Cozzoli ..... 294/82.33 |
| 3,213,508 | A | | 10/1965 | Vigerhed |
| 3,259,418 | A | | 7/1966 | Munday et al. |
| 3,317,972 | A | | 5/1967 | Harley |
| 3,493,260 | A | | 2/1970 | Smith |
| 3,575,458 | A | | 4/1971 | Crook, Jr. et al. |

(Continued)

*Primary Examiner* — Saul Rodriguez
*Assistant Examiner* — Gabriela Puig
(74) *Attorney, Agent, or Firm* — John K. Buche; Scott Compton; Buche & Associates, P.C.

(57) ABSTRACT

A load bearing hook assembly (e.g., an ROV hook or hoist hook) with (A) a main body operationally configured to attach to a support line, (B) a load bearing member attached to the main body and pivotal from a fully closed position to a fully open position, the load bearing member defining a gape of the hook assembly; and (C) a non-load bearing member pivotally attached to the main body operationally configured to obstruct the gape of the hook assembly.

11 Claims, 12 Drawing Sheets

(56) References Cited

U.S. PATENT DOCUMENTS

| | | | | | |
|---|---|---|---|---|---|
| 3,575,459 | A | | 4/1971 | Coblenz | |
| 3,722,943 | A | | 3/1973 | Kalua, Jr. | |
| 3,741,600 | A | | 6/1973 | Crook, Jr. | |
| 3,762,757 | A | | 10/1973 | Epstein | |
| 3,827,746 | A | | 8/1974 | Byers | |
| 3,911,671 | A | | 10/1975 | Guillen | |
| 3,926,467 | A | * | 12/1975 | Crissy et al. | 294/82.33 |
| RE28,709 | E | | 2/1976 | Crook, Jr. | |
| 4,013,314 | A | | 3/1977 | Archer | |
| 4,026,594 | A | | 5/1977 | Kumpulainen | |
| 4,050,730 | A | | 9/1977 | Tada et al. | |
| 4,061,103 | A | | 12/1977 | Mampaey | |
| 4,073,042 | A | | 2/1978 | Miller | |
| 4,093,293 | A | | 6/1978 | Huggett | |
| 4,095,833 | A | | 6/1978 | Lewis | |
| 4,114,940 | A | | 9/1978 | Brynemo et al. | |
| 4,118,840 | A | | 10/1978 | Fengels | |
| 4,121,867 | A | | 10/1978 | Muller | |
| 4,122,585 | A | | 10/1978 | Sharp et al. | |
| 4,144,709 | A | | 3/1979 | Dalferth et al. | |
| 4,174,132 | A | | 11/1979 | Crook, Jr. | |
| 4,195,872 | A | | 4/1980 | Skaalen et al. | |
| 4,201,410 | A | | 5/1980 | Crawford et al. | |
| 4,279,062 | A | | 7/1981 | Boissonnet | |
| 4,281,867 | A | | 8/1981 | Kariagin | |
| 4,320,561 | A | | 3/1982 | Muller et al. | |
| 4,358,146 | A | | 11/1982 | Goudey | |
| 4,389,907 | A | | 6/1983 | Epstein | |
| 4,434,536 | A | | 3/1984 | Schmidt et al. | |
| 4,471,511 | A | | 9/1984 | Phipps | |
| 4,530,535 | A | | 7/1985 | Hargreaves | |
| 4,539,732 | A | | 9/1985 | Wolner | |
| 4,554,712 | A | | 11/1985 | Le Beon | |
| 4,602,814 | A | | 7/1986 | Pellolio, Jr. | |
| 4,610,474 | A | | 9/1986 | Jaatinen | |
| 4,621,851 | A | | 11/1986 | Bailey, Jr. | |
| 4,678,219 | A | * | 7/1987 | Smith et al. | 294/82.33 |
| 4,689,859 | A | | 9/1987 | Hauser | |
| 4,714,288 | A | | 12/1987 | Tietze | |
| 4,765,667 | A | | 8/1988 | Hamrin | |
| 4,884,836 | A | | 12/1989 | Maye et al. | |
| 4,977,647 | A | | 12/1990 | Casebolt | |
| 4,998,763 | A | | 3/1991 | Henke | |
| 5,178,427 | A | | 1/1993 | Jorritsma | |
| 5,193,872 | A | | 3/1993 | Fujita | |
| 5,205,600 | A | | 4/1993 | Moore | |
| 5,271,128 | A | | 12/1993 | Storm | |
| 5,288,037 | A | | 2/1994 | Derrien | |
| 5,292,163 | A | | 3/1994 | Matsuyama | |
| 5,292,165 | A | | 3/1994 | Wiklund | |
| 5,340,181 | A | | 8/1994 | Matsuyama | |
| 5,513,886 | A | | 5/1996 | Cyr | |
| 5,687,931 | A | | 11/1997 | Hogan | |
| 5,704,668 | A | | 1/1998 | Ferrato | |
| 5,735,025 | A | | 4/1998 | Bailey | |
| 5,765,891 | A | | 6/1998 | Fredriksson | |
| 5,851,040 | A | | 12/1998 | Fredriksson | |
| 5,884,950 | A | | 3/1999 | Fredriksson | |
| 5,887,924 | A | | 3/1999 | Green et al. | |
| 5,899,512 | A | | 5/1999 | Wiklund | |
| 5,901,990 | A | | 5/1999 | McMillan | |
| 6,375,242 | B1 | | 4/2002 | Zingerman | |
| 6,379,202 | B1 | | 4/2002 | Liu | |
| 6,422,625 | B1 | | 7/2002 | Van Der Laan | |
| 6,427,296 | B1 | | 8/2002 | Chang | |
| 6,450,558 | B1 | | 9/2002 | Ringrose | |
| 6,601,274 | B2 | | 8/2003 | Gartsbeyn | |
| 6,654,990 | B2 | | 12/2003 | Liu | |
| 6,715,809 | B2 | | 4/2004 | Thompson | |
| 6,832,417 | B1 | | 12/2004 | Choate | |
| 7,077,445 | B2 | | 7/2006 | Yu | |
| 7,255,381 | B2 | | 8/2007 | Komizo et al. | |
| 7,384,085 | B2 | | 6/2008 | Steinhovden | |
| 7,431,363 | B1 | | 10/2008 | Loney | |
| 2005/0127695 | A1 | | 6/2005 | Cranston et al. | |
| 2006/0175851 | A1 | | 8/2006 | Snyder | |
| 2010/0229352 | A1 | | 9/2010 | Dunbar et al. | |
| 2011/0042984 | A1 | | 2/2011 | Rocourt et al. | |

* cited by examiner

HOOK ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Various mechanisms have been used to move, release, and retrieve rigging equipment in marine environments including subsea operations. One common mechanism used includes a lifting hook (also referred to as a ROV hook or hoist hook), which includes a standard hook with a modified safety latch attached to a line. Another common mechanism includes a shackle attached to a line, the shackle having a spring loaded pin that is ejected from the shackle when a release mechanism is activated. However, these hoisting mechanisms are not without their shortcomings.

For instance, in subsea operations and depending on the load, an individual or a remotely operated vehicle ("ROV") may be required to manipulate the hook or shackle in order to release and/or reattach the hook or shackle from/to the load. Regarding hooks, ample slack must be applied to the line in order to manipulate a hook in a manner to release the hook from a padeye of an object supporting a load attached thereto. For example, where a load is located on the seafloor, an ROV or individual must be strong enough to lift the hook and the attached rigging to create enough slack in the line to remove the hook from a padeye. In instances where the load is suspended in water, an ROV or individual must be strong enough to lift the hook, rigging, and the load attached thereto to create enough slack in the line to manipulate the hook in order to release the hook from the padeye thereby releasing the load attached thereto—usually meaning the hook has to be rotated in a manner to allow the attached load to release from the hook via gravity. Unfortunately, during the unhooking process support lines, e.g., cables, wire rope lanyards, may get kinked or damaged preventing a safety latch of the hook from closing. In addition, hook safety latches may fail due to any twisting and oscillating of loads as waves influence the vessel supporting a hook. Another negative attribute of known lifting hooks includes the possibility of unwanted foreign objects, e.g., scrap wire or rope, pushing open the safety latch and entangling the hook.

Shackles, including ROV shackles, are limited to one time use per trip subsea. And although shackles can be reassembled under water, shackles are typically more easily assembled manually at the surface with the intended rigging equipment prior to reentering the water. Also, a shackle will not release unless the attached load is completely removed from the shackle.

A load bearing device that overcomes the above mentioned shortcomings is desired.

SUMMARY

The present application is directed to a hook assembly, comprising (A) a main body operationally configured to attach to a support line; (B) a load bearing member attached to the main body and pivotal from a fully closed position to a fully open position, the load bearing member defining a gape of the hook assembly; and (C) a non-load bearing member pivotally attached to the main body operationally configured to obstruct said gape.

The present application is also directed to a hook assembly, comprising (A) a main body operationally configured to attach to a support line; and (B) a load bearing member pivotally attached to the main body defining a gape of the hook assembly; the main body having (1) a pivotal link assembly in communication with the load bearing member, and (2) a rotatable slot lock in communication with the link assembly, the rotatable slot lock being operationally configured to dictate pivot action of the load bearing member.

The present application is also directed to a hook assembly, comprising (A) a main body having a lift eye and a shank member; (B) a load bearing member pivotally attached to the shank member and defining a gape of the hook assembly; the main body having a link assembly pivotally attached to the shank member and pivotally attached to the load bearing member; and (C) a rotatable slot lock in communication with the shank member and link assembly; wherein the shank member has an aperture for receiving a part of the rotatable slot lock there through, the rotatable slot lock being slidable along the length of the aperture about a circular path.

The present application is also directed to a method for receiving and releasing a load subsea, comprising (I) providing subsea a hook assembly attached to a support line, the hook assembly including (A) a main body operationally configured to attach to the support line, (B) a load bearing member attached to the main body and pivotal from a first fully closed position to one or more open positions, the load bearing member defining a gape of the hook assembly when set at the first position, (C) a first safety feature operationally configured to maintain the load bearing member in a locked position; (II) with the hook assembly set to receive a load including the first safety feature being set in a locked position locking the load bearing member in a fixed load bearing position, directing a load onto the load bearing member; (III) releasing the load from the hook assembly by unlocking the first safety feature allowing the load bearing member to pivot to an open position.

The present application is also directed to a method for receiving and releasing a load subsea, comprising (I) providing subsea a hook assembly attached to a support line, the hook assembly including (A) a main body operationally configured to attach to the support line; (B) a load bearing member pivotally attached to the main body, the load bearing member being pivotable from a first closed position to a second open position, the load bearing member defining a gape of the hook assembly when set at the first position; the main body having (1) a pivotal link assembly in communication with the load bearing member, (2) a rotatable slot lock in communication with the link assembly, the rotatable slot lock being operationally configured to dictate pivot action of the load bearing member, and (3) a biased non-load bearing member pivotally attached to the main body in a manner effective to obstruct the gape when set in a fully closed position; (II) with the hook assembly set to receive a load including the rotatable slot lock being set in a locked position thereby locking the load bearing member, receiving a load onto the hook assembly by directing the load passed the non-load bearing member onto the load bearing member; (III) releasing the load from the hook assembly by turning the rotatable slot lock to an unlocked position to allow the load bearing member to pivot to the second open position.

BRIEF DESCRIPTION

Figure 1:
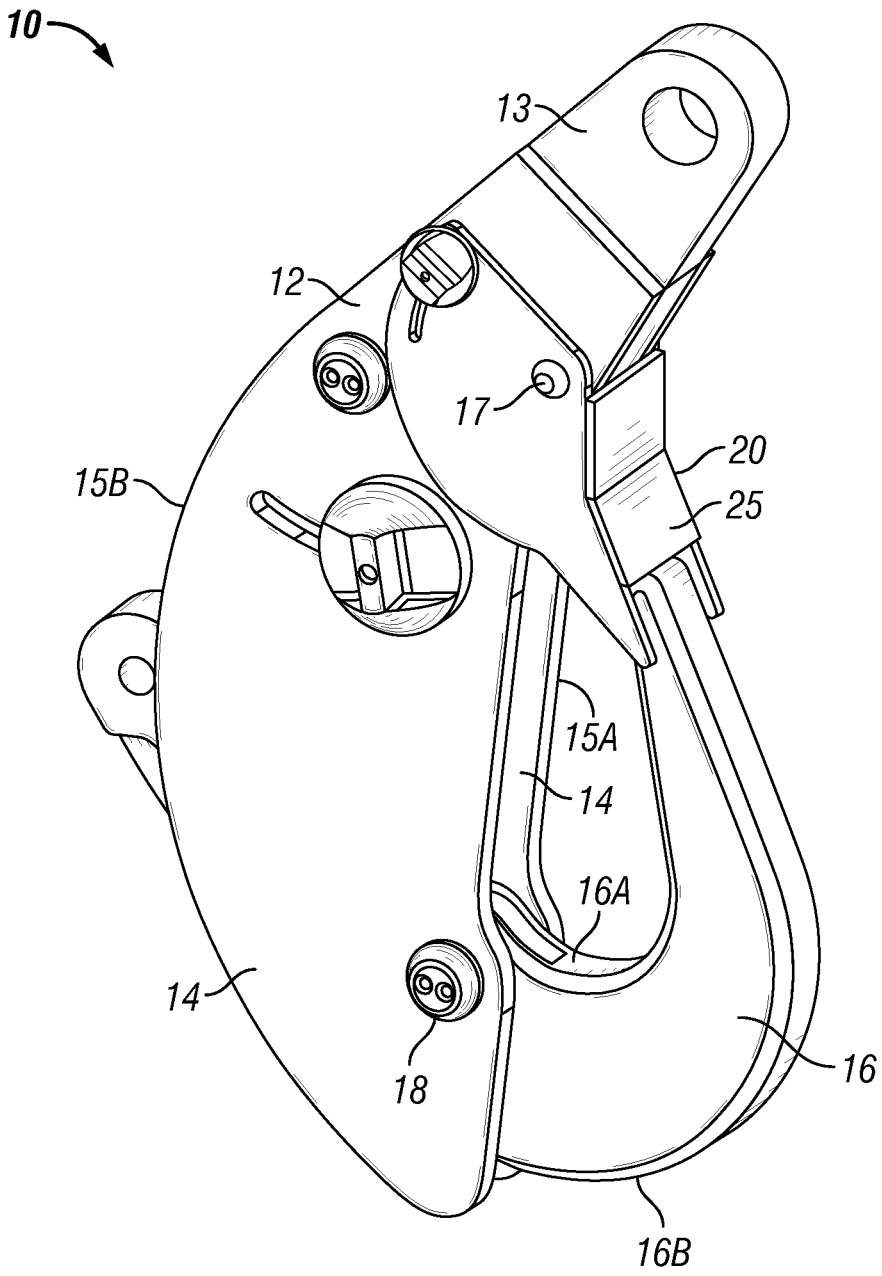
FIG. 1 illustrates a perspective view of a simplified embodiment of the hook assembly with the safety latch in a fully closed position.

It has been discovered that a hook assembly may be provided that is operationally configured to release a load subsea and thereafter be reset subsea to a load bearing position in order to receive a subsequent load. Such may be achieved by an individual diver or a ROV regardless of the size of the load or the attached rigging. Heretofore, such a desirable achievement has not been considered possible, and accordingly, the system and method of this application measure up to the dignity of patentability and therefore represents a patentable concept.

Before describing the invention in detail, it is to be understood that the present hook assembly and method are not limited to particular embodiments. It is also to be understood that the terminology used herein is for the purpose of describing particular embodiments only, and is not intended to be limiting. As used in this specification and the appended claims, the term "remotely operated vehicle" ("ROV") typically involves a tethered underwater robot as understood by persons of ordinary skill although it is contemplated that the ROV may be un-tethered. A "work class ROV," at the time of the filing of this application, refers to an ROV operationally configured to carry large collection devices with lifting capabilities up to about 136 Kg (about 300 pounds). Commercially available work class ROVs are available from the following commercial sources: Deep Sea Systems International Inc., Falmouth, Mass.; and Soil Machine Dynamics LLC, Houston, Tex. The term "surface" refers to the surface of a body of water and may include a structure located above the surface of the water such as dry land, the deck of a floating vessel, or the deck of an offshore platform structure. The present hook assembly will be referred to using common terms in the art of hooks. For example, the term "eye" or "lift eye" refers to a ring, hole, or loop at the end of a hook where a support line is attached. A "support line" refers to rope, cable, and the like, operationally configured to support a lifting hook. The term "shank" refers to the part of a hook from behind the eye to the beginning of the bend of the hook. The "bend" of a hook refers to the curved portion of the hook extending from the shank and ending just before the point of the hook. The term "gape" is the distance between the hook shank and the point. The "front length" of a hook is defined from the distal end of the point to the outermost edge of the bend. The "bite/throat" of a hook is the distance from the apex of the bend to its intersection with the gape. The "total length" of a hook is defined from the distal end of the eye to the outermost edge of the bend.

In one aspect, the application provides a hook assembly operationally configured to remotely release a load subsea using an ROV or diver.

In another aspect, the application provides a hook assembly operationally configured to release a load subsea and be reset to a load bearing position subsea for subsequent use.

In another aspect, the application provides a hook assembly including a pivotal load bearing hook member defining a gape of the hook assembly and operationally configured to accept rigging to support a load subsea.

In another aspect, the application provides a hook assembly including a pivotal non-load bearing member operationally configured to close off or otherwise obstruct the gape in a manner effective to keep any rigging attached to the hook assembly from releasing from the hook assembly and/or to keep any undesired rigging or other items from entering the gape of the hook assembly.

In another aspect, the application provides a hook assembly having a pivotal loading bearing member and a pivotal non-load bearing member, the load bearing member and non-load bearing member being pivotal about substantially the same plane.

In another aspect, the application provides a hook assembly having safety features operationally configured to set one or both of the pivotal load bearing member and pivotal non-load bearing member in a locked position.

In another aspect, the application provides a hook assembly having a framework for supporting a pivotal load bearing member within the framework.

In another aspect, the application provides a hook assembly including a plurality of link members operationally configured to dictate the pivotal position of the load bearing member.

In another aspect, the application provides a hook assembly including a plurality of link members operationally configured to maintain the load bearing member in a load bearing first position. Suitably, the link members are operationally configured to distribute stress in a manner effective to eliminate a stress concentration along the link members.

In another aspect, the application provides a hook assembly including one or more locking mechanisms for securing the link members of the hook assembly in a fixed position effective for maintaining the load bearing member in a fixed position.

In another aspect, the application provides a hook assembly including a lockable link assembly operationally configured to secure a load bearing member in a fixed position.

In another aspect, the application provides a hook assembly operationally configured to release rigging equipment and/or a load attached thereto independent of the size of the load or rigging equipment attached thereto.

In another aspect, the application provides a hook assembly that enables use of an ROV smaller and/or less powerful to release a specific load from the hook assembly in comparison to ROVs currently required to release the same load from known lifting hooks or shackle mechanisms.

In another aspect, the application provides a hook assembly having a safety mechanism operationally configured to guard against any accidental disengagement of a load attached thereto.

In another aspect, the application provides a hook assembly including a load-bearing member that may be directed from a locked position to a release position and back to a locked position subsea without having to recover the hook assembly to the surface to reset the hook assembly back to a locked load bearing position.

In another aspect, the application provides a hook assembly attachable to a support line, the hook assembly including a main body and a load-bearing member attached thereto. During operation, the orientation of the main body in space remains substantially constant as the load-bearing member is directed from a load bearing position to a release position and vice versa.

In another aspect, the application provides a hook assembly having safety features effective to guard against any undesired release of a load attached thereto during twisting and/or oscillating of attached loads in marine environments.

In another aspect, the application provides a hook assembly effective for use subsea to support loads greater in weight than a work class ROV is capable of lifting on its own power.

In another aspect, the application provides a hook assembly that may be built to scale.

In another aspect, the application provides a hook assembly that may be configured to meet specific industry standard requirements regarding lifting capacity, tensile strength, as well as other standards understood by persons of ordinary skill in the art of lifting hooks.

In another aspect, the application provides a method of handling a load subsea via a hook assembly without having to retrieve the hook assembly to the surface.

Discussion of the Device and Method

To better understand the novelty of the hook assembly and method of use thereof, reference is hereafter made to the accompanying drawings. With reference to FIG. 1, the present invention provides a hook assembly 10 including a main body 12 and a load bearing member 16 pivotally attached to the main body 12. In subsea operation where the hook assembly 10 is attached to a support line, the main body 12 is operationally configured to substantially maintain its orientation in space as the load bearing member 16 is pivoted about the main body 12.

The main body 12 is suitably defined by (1) a lift eye 13 located at a first end of the hook assembly 10, the lift eye 13 being operationally configured to receive a support line there through, and (2) a shank member 14 operationally configured to set the load bearing member 16 at a first load bearing position and a second non-load bearing position as desired. Although the configuration of the shank member 14 is not limited to any particular embodiment, a suitable shank member 14 includes a frame defined by a cavity or opening operationally configured to receive at least part of the load bearing member 16 therein. In one embodiment, the total length of the hook assembly 10, when set in a load bearing position, may be defined as the distance from the distal edge of the lift eye 13 to the opposing distal edge of the shank member 14. In another embodiment where the load bearing member 16 extends out beyond the distal edge of the shank member 14 when set in a load bearing position, the total length of the hook assembly 10 may be defined as the distance from the distal edge of the lift eye 13 to the distal edge of the load bearing member 16.

As FIG. 1 illustrates, a suitable shank member 14 may include a frame defined by substantially parallel side plates 14 attached to the lift eye 13, each of the side plates 14 being defined by a front side 15A and a rear side 15B. As shown, the load bearing member 16 is pivotally disposed between the side plates 14 via a pivot pin 18.

The load bearing member 16, referred to hereafter as a pivotal "hook bill 16," is represented as a non-linear member operationally configured to (1) define a gape of the hook assembly, and (2) support a load upon its inner surface 16A when the hook bill 16 is set at a load bearing position. As shown in FIG. 1, the inner and outer surfaces 16A, 16B of the hook bill 16 may include a curved configuration, or "J" shape, whereby the hook bill 16 defines the bend, the front length, the bite/throat, and gape of the hook assembly 10 as these terms are known by persons of ordinary skill in the art of hooks. It is also contemplated that one or more of the inner and outer surfaces 16A, 16B may include an "L" shape or another multi-section configuration as desired.

Without limiting the mode of attachment of the hook bill 16 to the shank member 14, one suitable hook bill 16 may include an aperture there through for receiving the pivot pin 18, the pivot pin 18 being either releasably attachable or permanently attachable to the shank member 14 as desired. In another embodiment, the hook bill 16 may include two opposing female type mating surfaces for receiving two male type pivot pins 18.

Still referring to FIG. 1, the main body 12 may also include a pivotal non-load bearing member 20 (hereafter referred to as a pivotal "safety latch 20") extending around the front side 15A of the side plates 14, the safety latch 20 being pivotally attached to the shank member 14 via a pivot pin 17 in a manner effective for opening, obstructing or otherwise closing off the gape of the hook assembly 10 when the hook assembly 10 is set at a load bearing position. As shown, the safety latch 20 may be operationally configured to receive a portion of the hook bill 16 there between in an overlapping manner to assist in sealing off the gape of the hook assembly 10. As such, when the safety latch 20 is set at a fully closed position about the main body 12 and the hook bill 16 is set to a load bearing position, the hook assembly 10 is operable to (1) maintain a load within the bite/throat during operation of the hook assembly 10 without the load releasing from the hook assembly 10, and/or (2) prevent entry of non-targeted items such as foreign objects into the bite/throat of the hook assembly 10.

Subsea operations often involve moving heavy equipment in the deep ocean and/or retrieving heavy equipment from the deep ocean back to the surface. As a result, in subsea applications it is often necessary to employ a work load ROV powerful enough to lift, rotate or otherwise manipulate a ROV hook to release a heavy load there from. However, even current work load ROVs are limited for use up to about 27.22 metric tons (about 30 tons) in subsea environments. The present invention overcomes these shortcomings by providing a hook assembly 10 that does not require lifting, turning, or rotating of the main body 12 to release a load there from. As a result, a diver or smaller observation class ROVs may be used to release heavy loads from the present hook assembly 10. Due to this ease of releasing loads, the present hook assembly 10 is operationally configured to support and release loads much greater than other known ROV hooks. For example, a hook assembly 10 as provided in FIG. 15 may support and release loads up to about 181.5 metric tons (about 200 tons) in subsea environments—approximately 667% greater load releasing capacity than known ROV hooks that require the assistance of commercially available work class ROVs.

To satisfy such load requirements, the present hook assembly 10 is suitably constructed from one or more materials operationally configured to support loads up to about 181.5 metric tons (about 200 tons) in subsea environments. Suitable materials include, but are not necessarily limited to materials resistant to corrosion, material degradation, and breaking in marine and subsea environments, and other outside mechanical and chemical influences. In one particular embodiment, suitable hook assembly 10 materials may include, but are not necessarily limited to metals, composite materials, and combinations thereof. In another particular embodiment, the hook assembly 10 may be constructed from an alloy steel. In still another particular embodiment, the hook assembly 10 may be constructed from high carbon steel, including for example, 4140 Grade high carbon steel. It is also contemplated that one or more of the hook bill 16, shank member 14, safety latch 20, and the link assembly (discussed below) may be constructed from one or more materials distinct from the other components of the hook assembly 10 as desired. In addition, the hook assembly 10 may be constructed from one or more materials of a particular color(s) or from one or more materials that may be coated or otherwise colored for subsea visibility, e.g., a fluorescent yellow.

Figure 2:
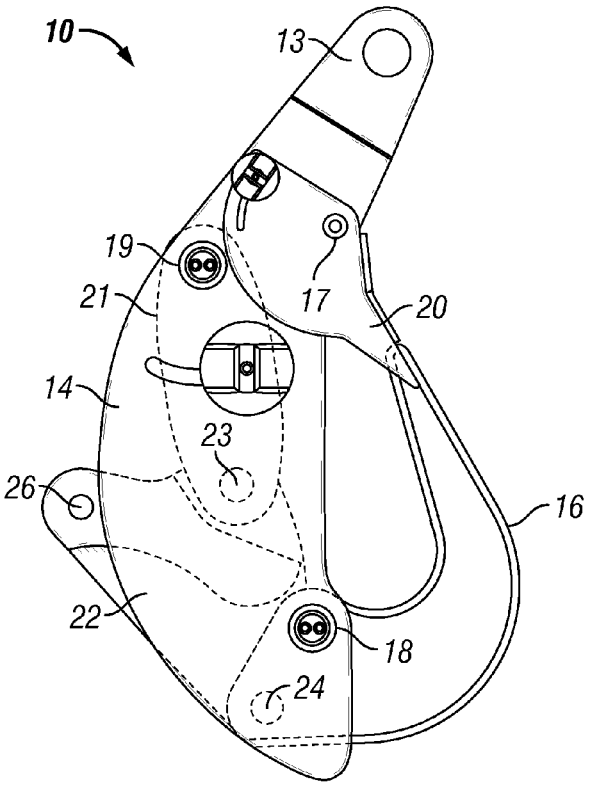
FIG. 2 is a side elevational phantom view of a simplified embodiment of the hook assembly with the safety latch in a fully closed position.

With reference to the embodiment of the hook assembly 10 as illustrated in FIG. 2, a particular feature of the present hook assembly 10 includes providing a main body 12 operationally configured to dictate pivot action of the hook bill 16 from a fully closed load bearing position to a fully open non-load bearing position. As shown, the hook assembly 10 suitably includes a main body 12 having a link assembly pivotally disposed between the side plates 14 for controlling the pivot action of the hook bill 16. The link assembly comprises (1) a first link 21 pivotally attached to at least one of the side plates 14 via pivot pin 19 defining a first pivot point of the first link 21, and (2) a second link 22 pivotally attached to the hook bill 16 via pivot pin 24 defining a first pivot point of the second link 22. As shown, the first link 21 and second link 22 are pivotally attached together at a second pivot point of the links 21, 22 via pivot pin 23.

Without limiting the invention, the pivot pins 17, 18, and 19 may be provided as dowel pins and the like operationally configured to pivotally couple the hook bill 16, safety latch 20 and first link 21 to the main body 12 as shown in FIG. 2. In one implementation, the hook assembly 10 may be permanently assembled via pivot pins 17, 18, and 19. In another implementation, the hook assembly 10 may be releasably assembled using releasable pivot pins 17, 18, and 19. The hook assembly 10 may also include pivot pins 23, 24 in the form of dowel pins and the like operationally configured to pivotally couple (1) link 21 to link 22, and (2) link 22 to hook bill 16, in either a permanent or releasable arrangement as desired.

Figure 15:
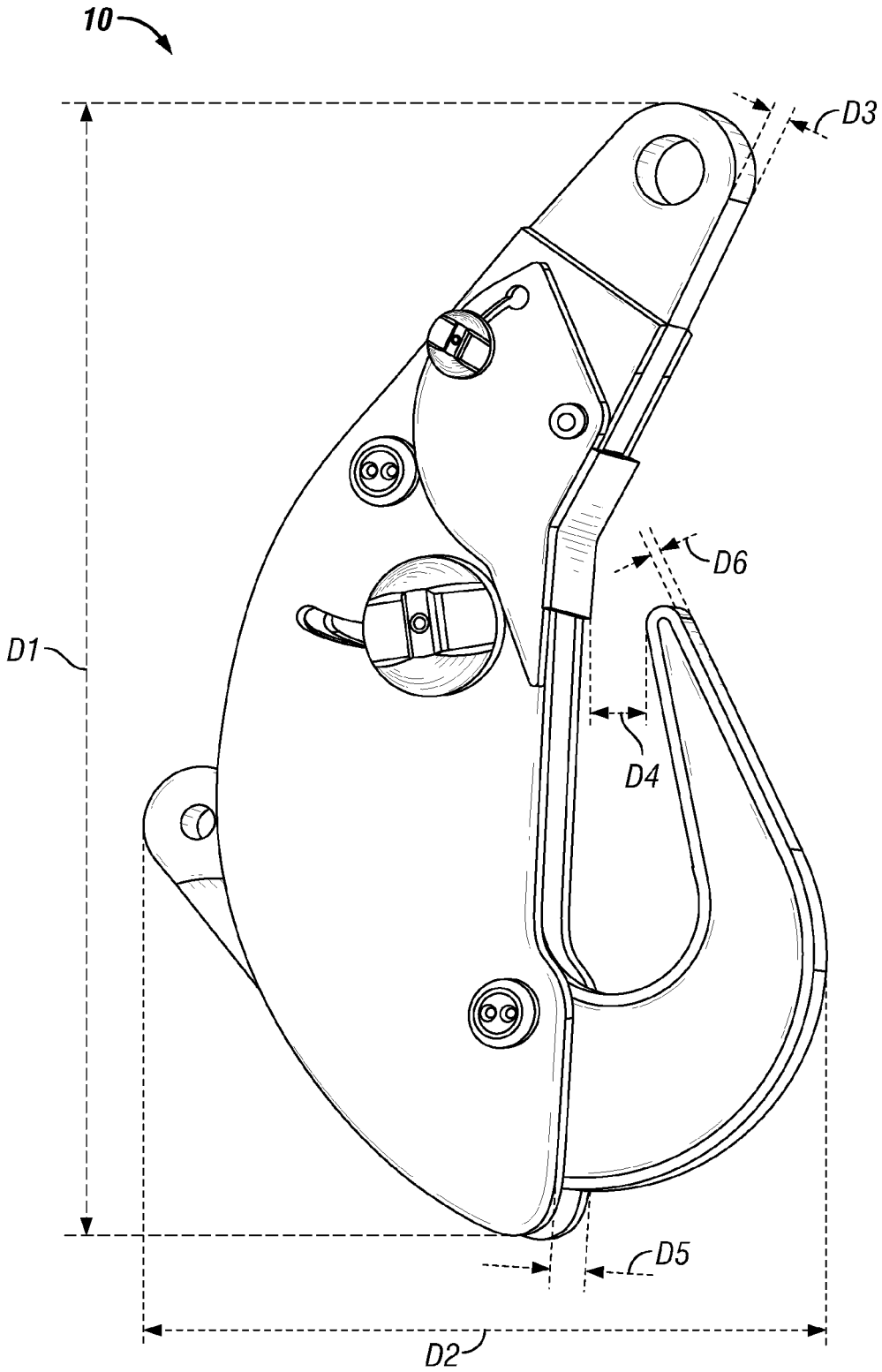
FIG. 15 is a perspective view of a simplified embodiment of the hook assembly.

As further shown in FIG. 2, the second link 22 may also include an aperture 26 there through, the aperture 26 being located at a point along the link 22 that remains exposed during operation of the hook assembly 10. As understood by persons of ordinary skill in the art of lifting hooks, the aperture 26 is operationally configured to receive a lanyard or like mechanism there through in a manner effective to manipulate the hook assembly 10 from a load bearing position to a non-load bearing position as desired. Suitable lanyards for use with the present hook assembly 10 may be constructed from materials including, but not necessarily limited to materials resistant to corrosion, material degradation, and breaking in marine and subsea environments and other outside mechanical and chemical influences. Suitable lanyard materials include, but are not necessarily limited to polypropylene rope, steel cable, stainless steel cable, plastic coated aircraft cable, and combinations thereof. In subsea operations using a hook assembly 10 as depicted in FIG. 15, a suitable lanyard includes polypropylene rope (1.27 cm; ½ inch rope) using a monkey's first as the term is understood by persons of ordinary skill in the art of knots.

Figure 3:
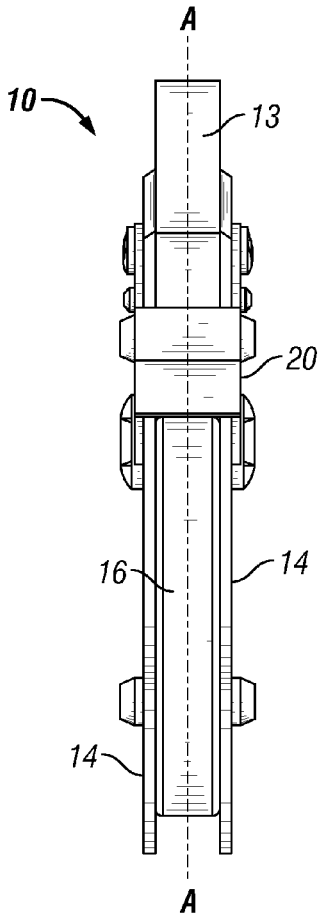
FIG. 3 is a front elevational view of a simplified embodiment of the hook assembly with the safety latch in a fully closed position.

Turning to FIG. 3, the hook bill 16 and safety latch 20 are suitably pivotal along substantially the same plane A-A where the safety latch 20 may pivot to a fully closed position to obstruct the gape of the hook assembly 10 when the hook bill 16 is set at a fully closed position (see FIG. 1). At a fully closed position, the safety latch 20 is suitably pivoted away from the side plates 14 while the hook bill 16 is pivoted toward the side plates 14. In the simplified embodiment of FIG. 1, at a fully closed position the outer surface of the lip 25 of the safety latch 20 rests along substantially the same plane as at least a portion of the outer surface 16B of the hook bill 16 although the outer surface 16B of the hook bill 16 is not necessarily limited to a particular surface configuration.

Figure 4:
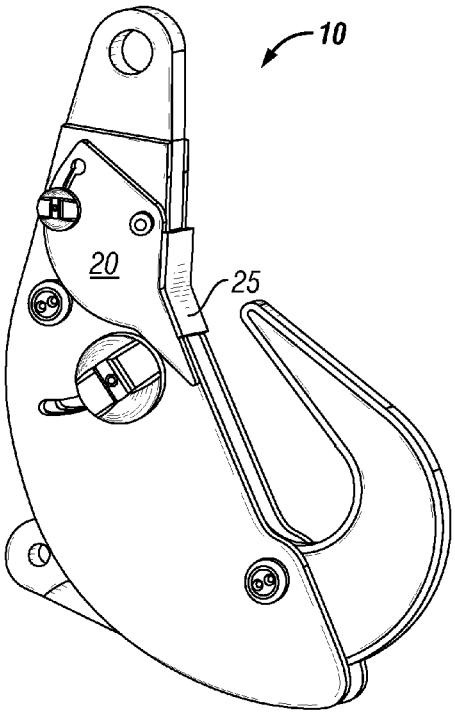
FIG. 4 is a perspective view of a simplified embodiment of the hook assembly with the safety latch in a fully open position.
Figure 5:
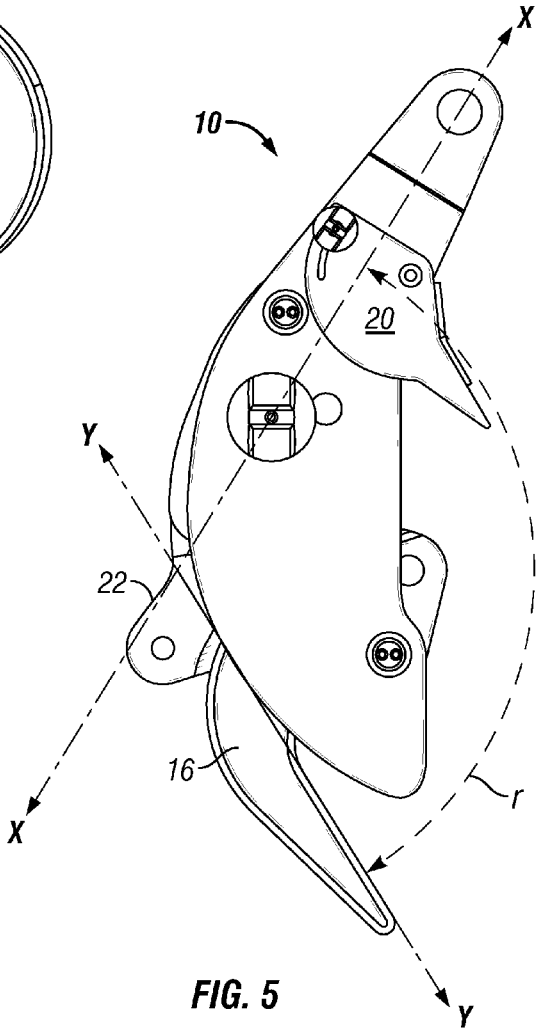
FIG. 5 is a side view of a simplified embodiment of the hook assembly with the load bearing member set to a fully open position.
Figure 6:
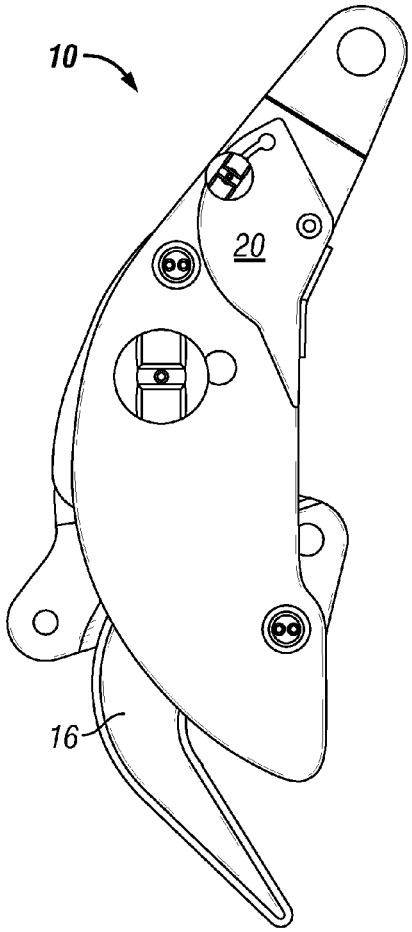
FIG. 6 is a side view of a simplified embodiment of the hook assembly with the load bearing member and the safety latch set to fully open positions.

From a fully closed load bearing position, one or both of the hook bill 16 and safety latch 20 may be pivoted to provide at least a partially unobstructed gape. As seen in FIG. 4, an unobstructed or open gape hook assembly 10 may be provided by simply pivoting the safety latch 20 toward the side plates 14. In this position, the lip 25 of the safety latch 20 lies substantially flush with the front edges 15A of the side plates 14. As seen in FIGS. 8B-8D, an open gape hook assembly 10 may also be provided by simply pivoting the hook bill 16 to an open position. As seen in FIG. 6, an open gape hook assembly 10 may also be provided by pivoting both the hook bill 16 and safety latch 20 to fully open positions. At a fully open position, the inner surface 16A of the hook bill 16 lies on a plane Y-Y forming a radius (r) of about 115 degrees in relation to the center line X-X of the lift eye 13 (see FIG. 5).

In one embodiment, the safety latch 20 may be pivoted to a fully open position to expose the gape by directly manipulating the safety latch 20 about the first pivot point 17. For example, a diver or an ROV may manually direct the safety latch 20 through its full range of motion. In another embodiment, the safety latch 20 may include a biased member operationally configured to maintain the safety latch 20 in a fully closed position until forced open. A suitable biased member includes, but is not necessarily limited to a compression spring. The hook bill 16 may also be pivoted manually by directly manipulating the hook bill 16. For example, a diver or ROV may directly manipulate the exposed portion of the second link 22 to pivot the hook bill 16. A diver or ROV may also pull a lanyard attached to the second link 22 at aperture 26 to pivot the hook bill 16.

Figure 7A:
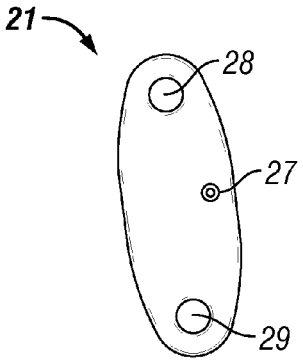
FIG. 7A is a simplified embodiment of a first link of the hook assembly.

In operation, pivot action of the hook bill 16 is dictated by (1) the configuration of the links 21, 22 and (2) the arrangement of the various pivot points of (a) the links 21 and 22, (b) the main body 12, and (c) the hook bill 16. With reference to FIG. 7A, a suitable first link 21 includes a planar member defined by an oblong or oval type outer perimeter and at least two apertures there through, a first aperture 28 being located near a first end of the link 21, and a second aperture 29 being located near a second end of link 21. The link 21 is suitably in communication with a locking mechanism via an attachment point 27 that is operationally configured to provided rotatable attachment of the locking mechanism as discussed in more detail below. In operation, aperture 28 accommodates pivotal attachment of the link 21 to the side plates 14 and aperture 29 accommodates pivotal attachment of the link 21 to the second link 22. In operation, the first link 21 is substantially pivotal along plane A-A about aperture 28 at third pivot point 19.

Figure 7B:
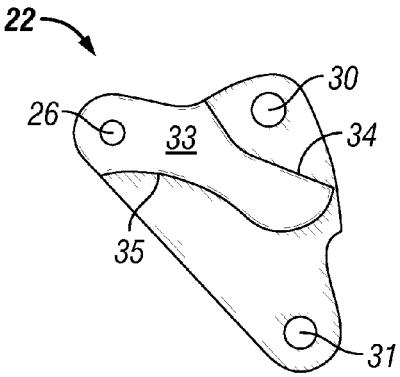
FIG. 7B is a simplified embodiment of a second link of the hook assembly.

Turning to FIG. 7B, a suitable second link 22 may be defined by an irregularly shaped member operationally configured for effective pivoting and setting of the link assembly and the hook bill 16 in a fully closed position or a fully open position. As shown, the second link 22 may include a substantially three sided outer perimeter including one or more linear and/or non-linear sides. In addition to the lanyard type aperture 26, the second link 22 also includes at least two other apertures 30, 31 operationally configured to accommodate pivotal attachment of the second link 22 to both the first link 21 (via pivot pin 23) and the hook bill 16 (via pivot pin 24).

The second link 22 also includes a raised surface 33 or protuberance effective for providing column strength to the second link 22. In one aspect, the raised surface 33 or protuberance is operationally configured to provide clearance for each of the first link 22 and hook bill 16 as the hook assembly 10 is set to a fully open position. In another aspect, the raised surface 33 or protuberance is operationally configured to assist in maintaining the hook bill 16 in a fully open position, independent of any other locking mechanisms, discussed in detail below. In one embodiment, the raised surface 33 or protuberance may be defined by (1) a first edge 34 operationally configured to provide clearance for link 21 during operation, and (2) a second edge 35 operationally configured to provide clearance for the hook bill 16 during operation.

Figure 8A:
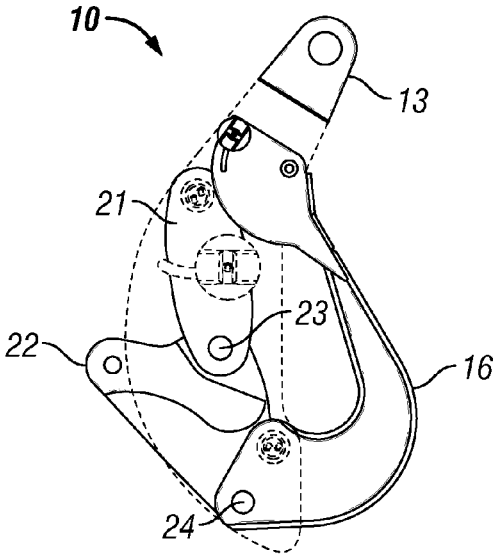
FIG. 8A is a partial phantom side view of a simplified embodiment of the hook assembly in a fully closed position.
Figure 8B:
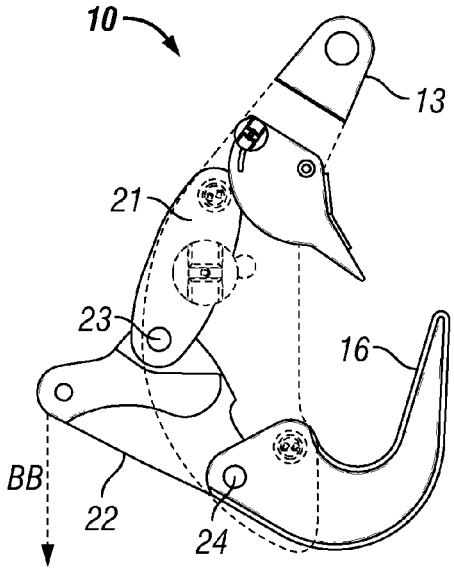
FIG. 8B is a partial phantom side view of a simplified embodiment of the hook assembly in a partially open position.
Figure 8C:
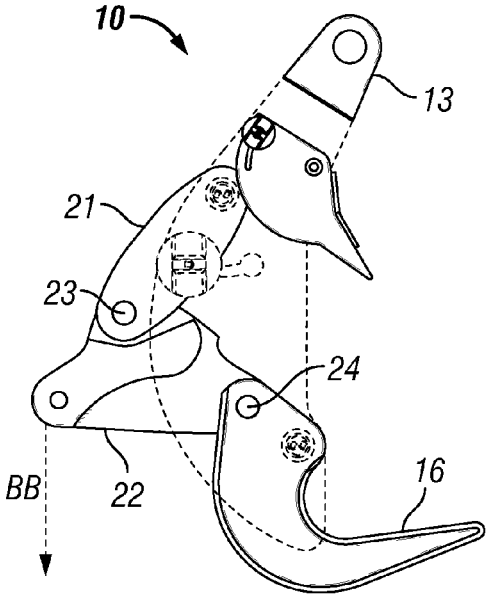
FIG. 8C is a partial phantom side view of a simplified embodiment of the hook assembly in a partially open position.
Figure 8D:
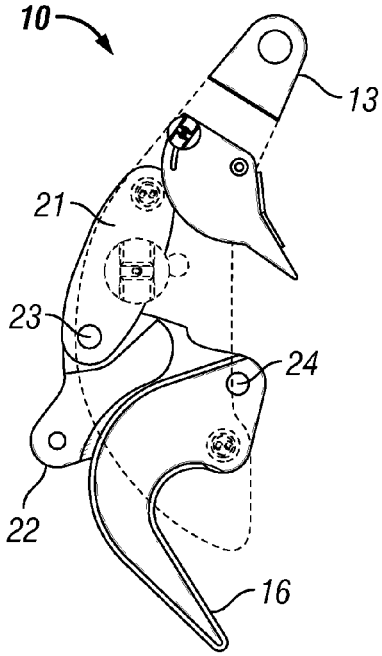
FIG. 8D is a partial phantom side view of a simplified embodiment of the hook assembly with the load bearing member set to a fully open position.

With reference to FIG. 8A, the configuration of the links 21, 22 and the arrangement of their various pivot points distribute stress in a manner effective to eliminate a stress concentration along the link members 21, 22. In other words, unlike known hooks that employ a latch or similar object to release a load bearing member—where the amount of stress near the edge of the latch approaches infinity due to the area approaching zero just before the latch is released—the present link assembly configuration overcomes such drawbacks because the area remains substantially constant up to the point of release of the load bearing member 16 (referred to herein as a stress constant link configuration when the load bearing member is in a fully closed position).

With reference to FIG. 8D, the raised surface 33 may also serve as a landing surface or support surface for the first link 21 during operation. In addition, the second edge 35 of the raised surface 33 may be operationally configured to at least partially abut the outer surface of the hook bill 16 when the hook bill 16 is in a fully open position as shown in FIG. 8D. In another embodiment, the surface of substantially the entire second edge 35 may correlate in shape to the outer surface of the hook bill 16 for abutment of substantially the entire second edge 35 with the hook bill 16. As illustrated in FIG. 8D, the configuration of the first and second edges 34, 35 are operationally configured to prevent pivoting of the link assembly and hook bill 16 back to a fully closed position of the hook bill 16 thereby maintaining the hook bill 16 in a fully open position, independent of any locking mechanisms. In particular, the bend of the hook bill 16 abutting the second edge 35 acts as a shoulder operationally configured to prevent the link assembly from pivoting back to a fully closed position of the hook bill 16. In a fully open position, the raised surface 33 is suitably sandwiched between at least part of the first link 21 and at least part of the hook bill 16 wherein the configuration of (1) the first and second edges 34, 35, (2) first link 21, and (3) hook bill 16 are effective to prevent pivoting action of the link assembly until directed back to the fully closed position via a diver or ROV. At a fully open position (FIG. 8D), the surface area of both the first link 21 and hook bill 16 overlapping the second link 22 is greater than the surface area of the first link 21 and hook bill 16 overlapping the second link 22 at a fully closed position of the hook bill 16 (FIG. 8A). In more detail, as the hook assembly 10 is directed from a fully closed position to a fully open position, the first link 21 pivots away from the hook bill 16 (toward rear side 15B) prior to pivoting back toward the hook bill 16 (toward front side 15A) to rest at a second position (FIG. 8D), which is closer in proximity to the outer surface 16B of the hook bill 16 than the first link 21 at its first position (FIG. 8A).

FIGS. 8A-8D illustrate suitable pivot action of the links 21, 22 and the hook bill 16 from a fully closed load bearing position of the hook assembly 10 to a fully open non-load bearing position of the hook bill 16. In detail, as the exposed portion of the second link 22 is directed away from the lift eye 13 (see arrow BB), the shape of the second link 22 in combination with its point of pivotal attachment to the first link 21 and the point of pivotal attachment of the first link 21 to the side plates 14 are operationally configured to provide for non-linear movement of the pivot pin 23 from a first position out passed the rear side 15B of the side plates 14 (see FIG. 8C) prior to the pivot pin 23 reaching a second position between the side plates 14 (see FIG. 8D). As FIG. 8D further illustrates, as the exposed portion of the second link 22 is directed away from the lift eye 13, pivot pin 24 is directed rotationally out passed the front side 15A of the main body 12 as the second link 22 is rotated.

Figure 9:
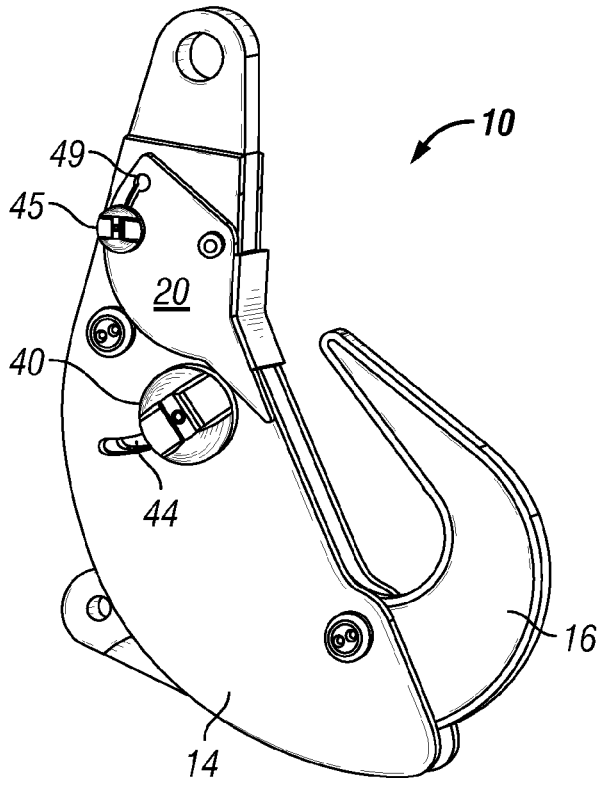
FIG. 9 is a perspective view of a simplified embodiment of the hook assembly including the safety latch in a fully open position and the load bearing member in a fully closed position.

Turning to FIG. 9, the hook assembly 10 may also include one or more locking mechanisms operationally configured to set the hook bill 16 in one or more fixed positions. For example, the hook assembly 10 may include a rotatable slot lock comprising a first rotatable locking member (hereafter "first safety lock 40") in communication with a side plate 14 and the first link 21, the first safety lock 40 being operationally configured to act on the first link 21 in a manner effective to set the link assembly and the hook bill 16 in either a fully open or fully closed fixed position. The hook assembly 10 may also include a second rotatable locking member (hereafter "second safety lock 45") operationally configured to act on the safety latch 20 in a manner effective to set the safety latch 20 in a fully open or fully closed fixed position. In the embodiment of FIG. 9, the second safety lock 45 may include a similar slot lock configuration. In another embodiment, the first safety lock 40 and second safety lock 45 may be provided as dissimilar locking mechanisms.

Figure 10A:
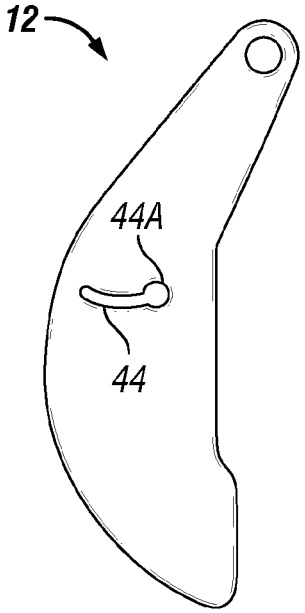
FIG. 10A is a simplified embodiment of a side plate of the hook assembly.
Figure 10B:
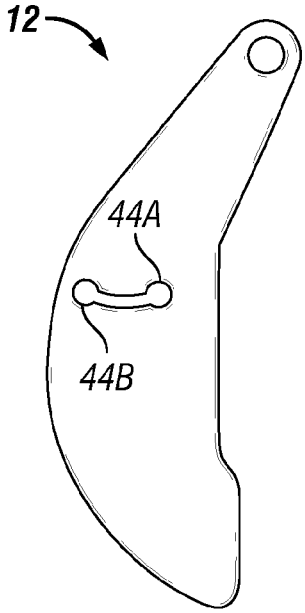
FIG. 10B is another simplified embodiment of a side plate of the hook assembly.

The first safety lock 40 is located adjacent the outer surface of one of the side plates 14 and in communication with the first link 21 via an aperture in the corresponding side plate 14. The aperture is provided in the form of a slot 44 operationally configured to receive at least part of the first safety lock 40 there through. In one embodiment, the slot 44 may include a circular path as represented in FIG. 10A, including an enlarged end section 44A. In another embodiment, the slot 44 may include a circular path as represented in FIG. 10B, including enlarged end sections 44A and 44B. In a suitable embodiment, the slot 44 is operationally configured to allow the first safety lock 40 to slide within the slot 44 along a circular path from about 16.0 to about 17.0 degrees. In another suitable embodiment, the slot 44 is operationally configured to allow the first safety lock 40 to side within the slot 44 along a circular path about 16.7 degrees. In like manner, the safety latch 20 may include an aperture or slot 49 operationally configured to receive a portion of the second safety lock 45 there through. As such, slot 49 may include a similar circular path as slot 44 including the enlarged end sections as depicted in FIGS. 10A and 10B.

Figure 11A:
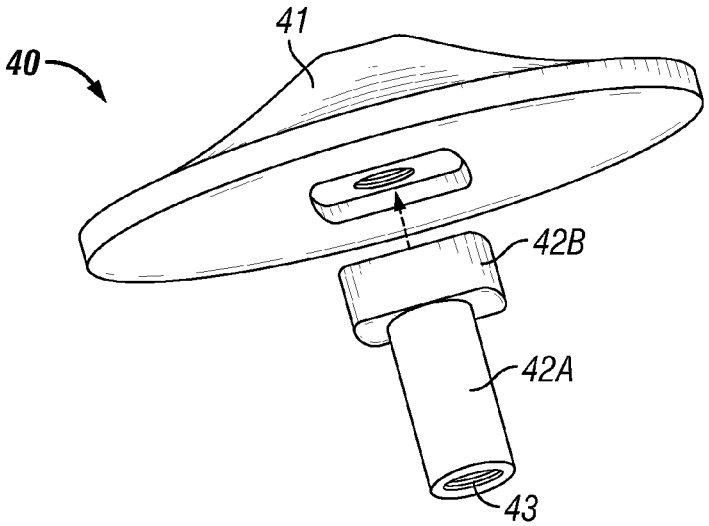
FIG. 11A is a simplified embodiment of a safety lock of the hook assembly.
Figure 11B:
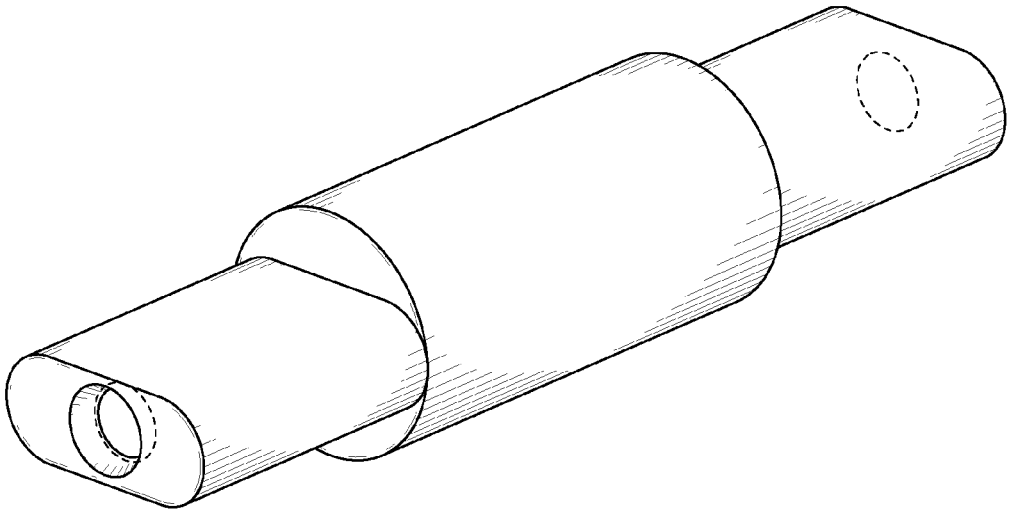
FIG. 11B is a simplified embodiment of a pin section of a safety lock of the hook assembly.

As FIG. 11A illustrates, the safety locks 40, 45 may include rotatable locking mechanisms including (1) an outer knob 41 for manual control, the knob 41 being located external of the side plates 14, and (2) a pin 42A and cam 42B section extending from the knob 41 through the corresponding slots 44, 49. In one embodiment, the safety locks 40, 45 may include one piece construction. In another embodiment, the safety locks 40, 45 may include a pin 42A and cam 42B section operationally configured to releasably mate with the outer knob 41 as shown in FIG. 11A, wherein fastening means (not shown) may be employed to join the knob 41 and cam 42B. In another embodiment, as shown in FIG. 11B, the pin may include opposing ends that are smaller than a central section. In one simplified illustration, a metal type pin material may be milled down at the opposing ends whereby the ends are smaller than the outer diameter of the original stock material used to construct the pin.

The first safety lock 40 suitably includes a means for rotatable attachment to the first link 21, while the second safety lock 45 suitably includes a means for rotatable attachment to one of the side plates 14. Without limiting the invention to a particular mode of attachment, the pin 42A may be threadedly connected, snap fit, ball joint, or otherwise rotatably attached to a target surface as desired. For example, the pin 42A of the first safety lock 40 may be rotatably attached to the rotatable attachment 27 of the first link 21 via a coupling member 43 located at the distal end of the pin 42A.

Figure 12A:
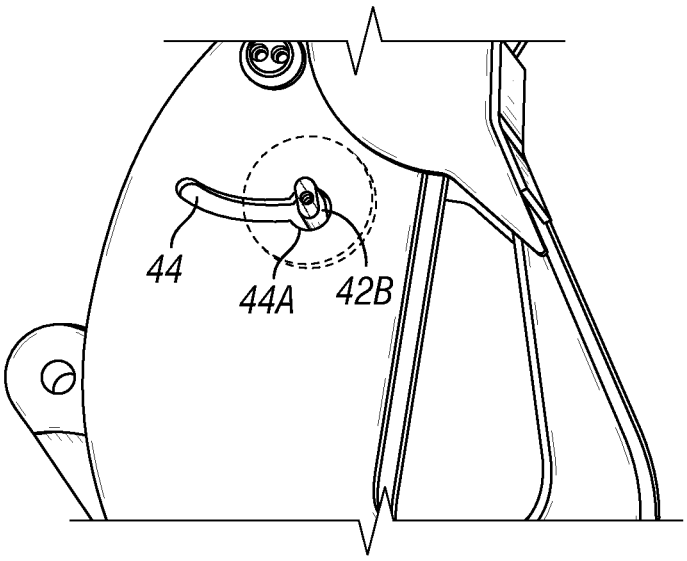
FIG. 12A is a partial view of a simplified embodiment of the hook assembly illustrating a partial phantom view of a safety lock in a locked position with the load bearing member in a fully closed position.
Figure 12B:
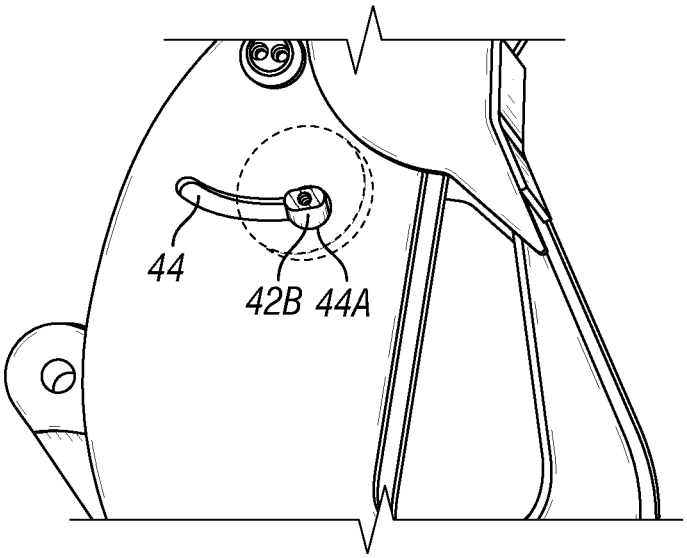
FIG. 12B is a partial view of a simplified embodiment of the hook assembly illustrating a partial phantom view of a safety lock in an unlocked position.

Referring to FIGS. 12A and 12B, the longitudinal axis of the pin 42A and cam 42B section is orientated substantially perpendicular to plane A-A. As shown, a suitable rotatable cam 42B includes (1) a width less than the width of the corresponding slot 44, 49, and (2) a length greater than the width of the corresponding slot 44, 49, the cam 42B being in communication with the sidewall of the slot 44. Furthermore, the orientation of the cam 42B and width of the corresponding slot 44, 49 are operationally configured to maintain the hook bill 16 and link assembly in one or more of a fixed position and pivotal position as desired. With particular attention to FIG. 12A, a fixed or locked position of the first safety lock 40 is defined by a cam 42B extending out from the knob 41 adjacent the sidewall of the slot 44 and oriented lengthwise substantially perpendicular to the mouth of the slot 44 in a manner effective to maintain the first safety lock 40 within the enlarged section 44A, thereby fixing the first link 21, second link 22 and hook bill 16 in a fully closed fixed position providing a load bearing position of the hook assembly 10.

The first safety lock 40 may be switched from a locked position to an unlocked position, and vice versa, by simply rotating the outer knob 41. As shown in FIG. 12B, the safety lock 40 may be adjusted from a locked position to an unlocked position by turning the outer knob 41 and the cam 42B about 90 degrees orienting the cam 42B directionally lengthwise with the elongated section of the slot 44 to allow the cam 42B to slide out from the enlarged section 44A along the length of the slot 44.

For suitable operation of the link assembly and the hook bill 16, the shape of the slot 44 substantially correlates to the path in space of the pin 42A and cam 42B section, which is dictated according to the attachment point of the first safety lock 40 to the first link 21 and the attachment point of the first link 21 to the side plate 14. Thus, as the first link 21 pivots (see FIGS. 8A-8D) the cam 42B slides unobstructed along the length of the slot 44. Thus, the length of the slot 44 is at least as long as the travel distance of the cam 42B.

As discussed above, when the hook bill 16 is set to a fully open position, the configuration of the mating surfaces between the second link 22, first link 21, and hook bill 16 are effective to maintain the hook assembly 10 in a fully open position (see FIG. 8D) until the second link 22 is directed back toward its first position (see FIG. 8A). In an embodiment including a slot 44 as illustrated in FIG. 10B, the hook assembly 10 may be locked in a fully open position by rotating the first safety lock 40 about 90 degrees to maintain the cam 42B in a locked position within the enlarged section 44B.

Figure 13A:
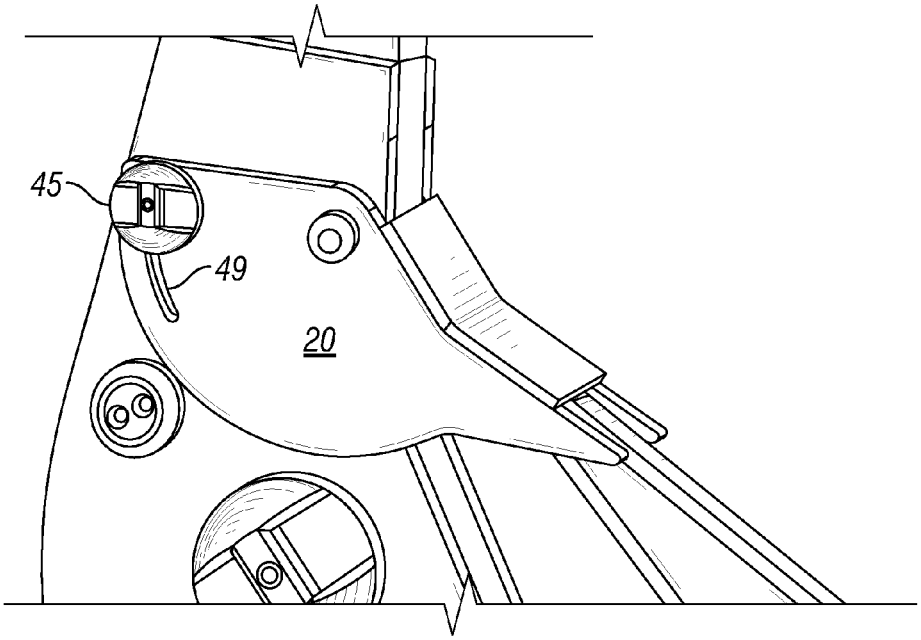
FIG. 13A is a partial view of a simplified embodiment of the hook assembly illustrating including a safety lock of the safety latch in an open orientation.
Figure 13B:
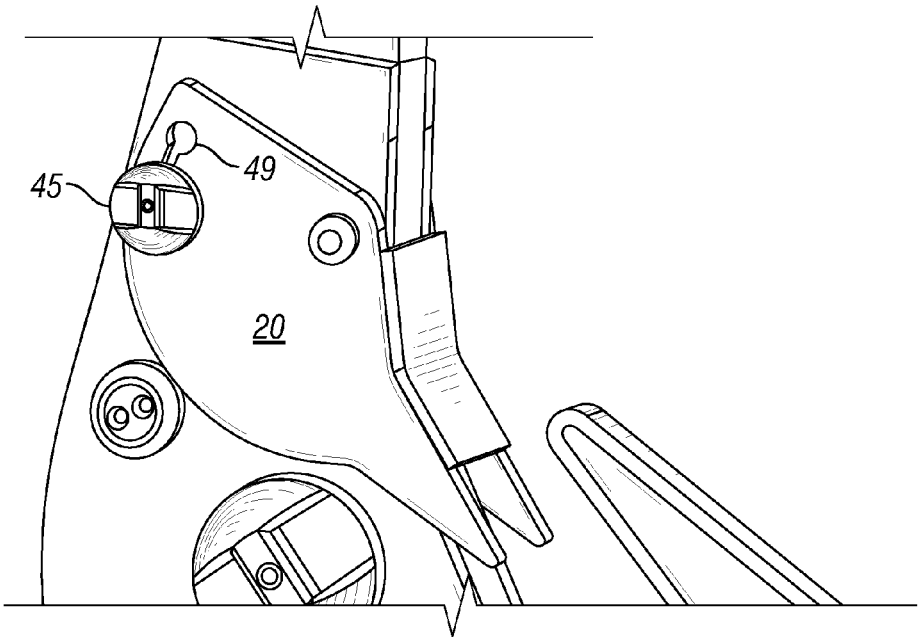
FIG. 13B is a partial view of the simplified embodiment of the hook assembly of FIG. 13A including the safety latch in an open position.

Referring now to FIGS. 13A and 13B, the safety latch 20 may be locked and unlocked according to the safety lock 45 and slot 49 in a manner similar as the safety lock 40 and slot 44 described above, the difference being that the safety lock 45 is rotatably fixed to the main body 12. Suitably, the slot 49, which is disposed along the safety latch 20, may be directed through its entire length about a fixed pin, including for example pin 42A and cam 42B section, as the safety latch 20 pivots between a closed position and an open position. When the safety latch 20 is set to a locked position (see FIG. 1) the safety latch 20 remains fixed in a fully closed position obstructing the gape.

Operation of the Hook Assembly

In subsea operations, a load is typically fastened to a lifting wire, which is attached to a hoisting mechanism such as a support line and lifting hook or shackle. For purposes of this application, a suitable marine type lifting wire 200 may include a loop or like member that is operationally configured to slip onto the hook bill 16 in a manner effective for the safety latch 20 to rest in a fully closed position.

Prior to attaching a lifting wire 200 to the hook assembly 10, the first safety lock 40 is suitably set to a locked position to secure the hook bill 16 in a fully closed load bearing position. In an embodiment including a safety latch 20 provided with a biased member, as the lifting wire 200 is attached to the hook assembly 10 the lifting wire 200 contacts the safety latch 20 directing the safety latch 20 toward an open position whereby the lifting wire 200 may pass into the bite/throat of the hook assembly 10 and rest on the inner surface 16A of the hook bill 16. In an embodiment operationally configured for manual control of the safety latch 20, the safety latch 20 may be set to an open position and thereafter reset to a closed position via the second safety lock 45 once the lifting wire 200 is set within the bite/throat of the hook assembly 10. In a closed position, the safety latch 20 is operationally configured to obstruct the gape in a manner effective (1) to maintain the lifting wire 200 attached to the hook assembly 10 and/or (2) to prevent any undesired rigging or other objects from entering the gape of the hook assembly 10.

Figure 14A:
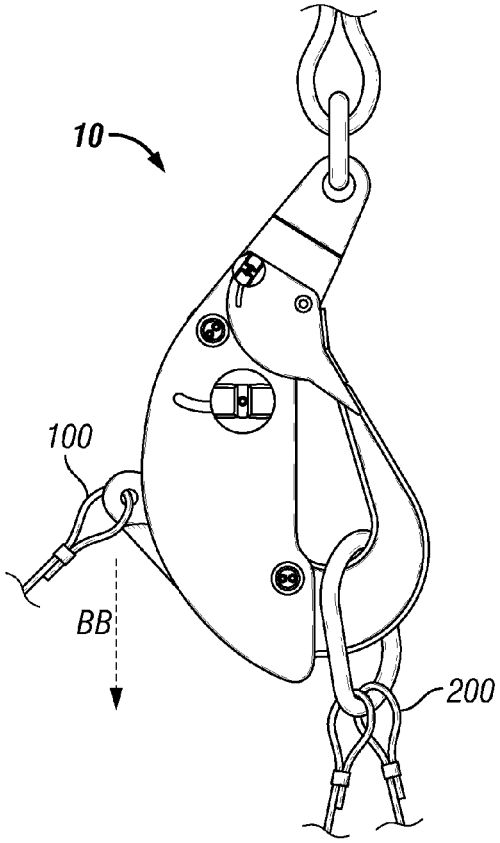
FIG. 14A is a simplified embodiment of the hook assembly in a locked load bearing position.
Figure 14B:
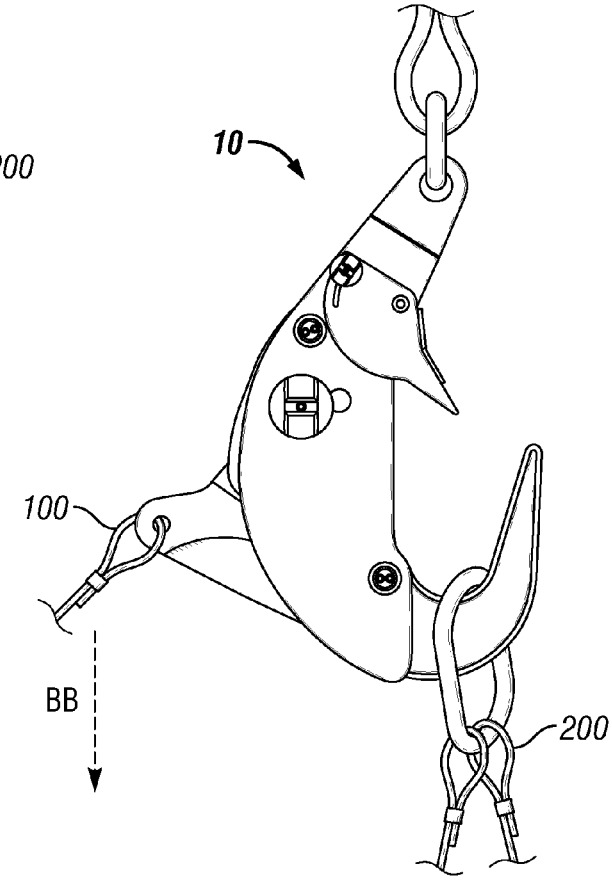
FIG. 14B is a simplified embodiment of the hook assembly illustrating the load bearing member in a partially open position.
Figure 14C:
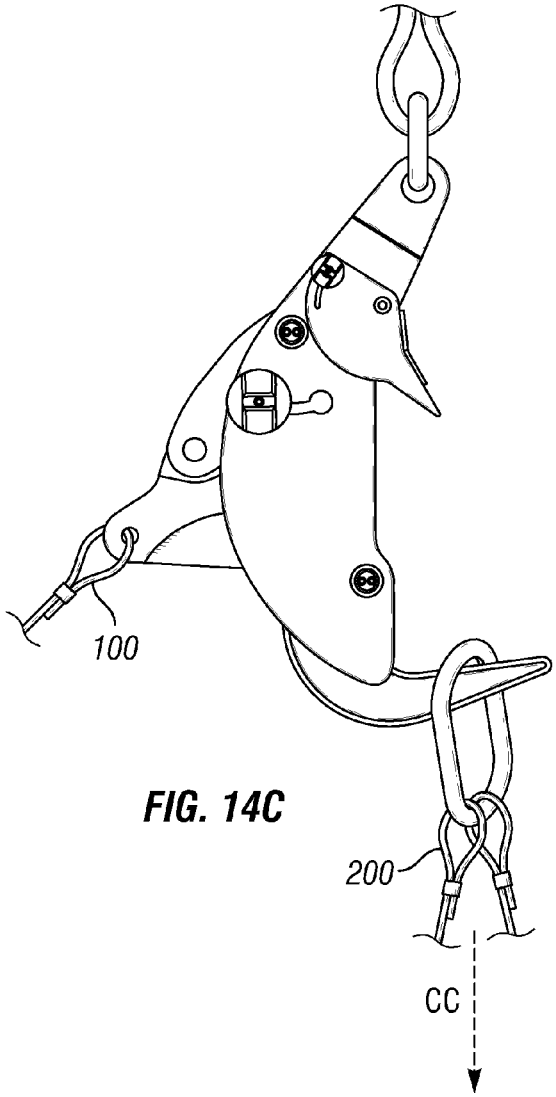
FIG. 14C is a simplified embodiment of the hook assembly illustrating the load bearing member in a partially open position.
Figure 14D:
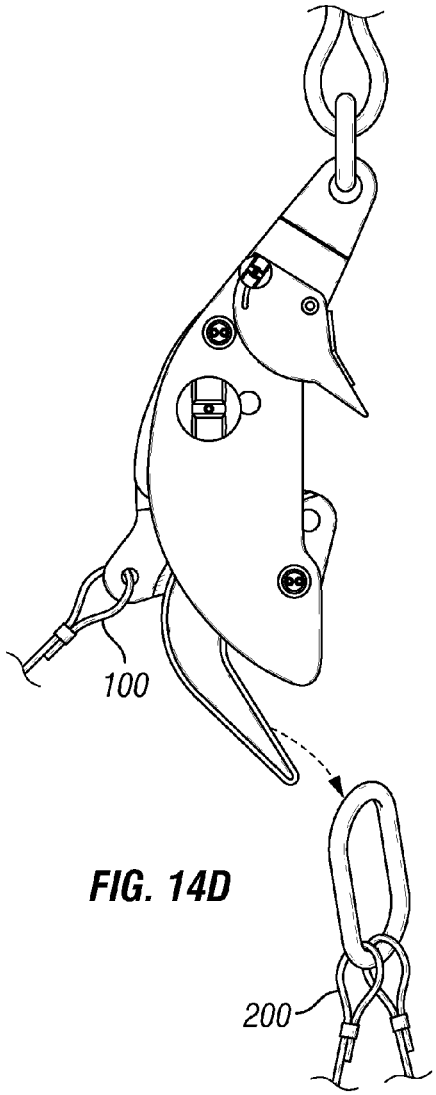
FIG. 14D is a simplified embodiment of the hook assembly illustrating the load bearing member in a fully open position.

Once the lifting wire 200 is attached to the hook assembly 10 (see FIG. 14A) the load may be suspended, raised to the surface, or otherwise redirected as desired. Once a particular task is performed, the lifting wire 200 may be released from the hook assembly 10 as illustrated in FIGS. 14B-14D.

The present hook assembly 10 is advantageous in that an individual may manually unlock the hook assembly 10 to release a load there from and then reset the hook assembly 10 to a load bearing position regardless of the weight of the load attached thereto. For example, the safety lock 40 may be set to an unlocked position by a diver or ROV subsea where after the diver or ROV may pull on the lanyard 100 attached to the second link 22 in a direction as represented by directional arrow BB to manipulate the links 21, 22 and pivot the hook bill 16 to a fully open position effective to release the lifting wire 200 as in FIG. 14D. In another embodiment, the weight of the load alone may be enough to trigger pivoting action of the link assembly and hook bill 16 without assistance from a diver or ROV. In such embodiment, once a diver or ROV sets the safety lock 40 to an unlocked position, the force vector CC created by the load upon the hook bill 16 is great enough to direct the hook bill 16 to an open position whereby the lifting wire 200 may be drawn away from the hook assembly 10 via gravity (although water current or other forces could assist the release of a load from the hook assembly 10).

Following release of the lifting wire 200, a diver or ROV may manipulate the links 21, 22 and the hook bill 16 back to a fully closed position and set the first safety lock 40 to a locked position to receive future loads without removing the hook assembly 10 from the subsea environment, although this activity may be performed at the surface if desired.

The invention will be better understood with reference to the following non-limiting example, which is illustrative only and not intended to limit the present invention to a particular embodiment.

Example 1

In a first non-limiting example, a subsea hook assembly 10 constructed from 4140 Grade high carbon steel is provided. With reference to FIG. 15, a hook assembly 10 is provided according to the following parameters:

D1: about 61.0 cm (about 24 inches)
D2: about 30.5 cm (about 12 inches)
D3: about 3.18 cm (about 1.25 inches)
D4: about 4.45 cm (about 1.75 inches)
D5: about 8.26 cm (about 3.25 inches)
D6: about 3.18 cm (about 1.25 inches)

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A hook assembly, comprising:

a main body operationally configured to attach to a support line;

a load bearing member pivotally attached to the main body defining a gape of the hook assembly the main body having (1) a pivotal link assembly in communication with the load bearing member, and (2) a rotatable slot lock in communication with the link assembly, the rotatable slot lock being operationally configured to dictate pivot action of the load bearing member;

a non-load bearing member pivotally attached to the main body, the non-load bearing member being operationally configured to obstruct said gape when pivoted to a fully closed position about the main body; and, a rotatable slot lock operationally configured to maintain the non-load bearing member in an open position.

2. A hook assembly, comprising:

a main body operationally configured to attach to a support line;

a load bearing member pivotally attached to the main body defining a gape of the hook assembly;

the main body having (1) a pivotal link assembly in communication with the load bearing member, and (2) a rotatable slot lock in communication with the link assembly, the rotatable slot lock being operationally configured to dictate pivot action of the load bearing member; and, wherein the main body includes an aperture for receiving at least part of the rotatable slot lock there through, the rotatable slot lock being rotatable attached to the link assembly and slidable along a circular path within the aperture.

3. The hook assembly of claim 2 wherein the rotatable slot lock includes a rotatable cam in communication with the sidewall of the aperature.

4. The hook assembly of claim 3 wherein the aperture includes an enlarged end section, the orientation of the cam within the enlarged end section dictating a locked position of the load bearing member.

5. The hook assembly of claim 4 wherein the rotatable slot lock includes a rotatable knob attached to the cam.

6. The hook assembly of claim 4 wherein the main body includes a frame operationally configured to receive the link assembly therein, the link assembly including a first link and a second link, the first link being pivotally attached to the frame at a first pivot point and pivotally attached to the second link at a second pivot point, the second link being pivotally attached to the load bearing member at a first pivot point and pivotally attached to the first link at a second pivot point.

7. The hook assembly of claim 6 wherein the distance from the aperture to the first pivot point of the first link defines a radius of the guide path of the rotatable slot lock.

8. The hook assembly of claim 2 wherein the rotatable slot lock is slidable along a circular path within the aperture from about 16.0 degrees to about 17.0 degrees.

9. A hook assembly, comprising:

a main body having a lift eye and a shank member;

a load bearing member pivotally attached to the shank member and defining a gape of the hook assembly;

the main body having a link assembly pivotally attached to the shank member and pivotally attached to the load bearing member; and a rotatable slot lock in communication with the shank member and link assembly;

wherein the shank member has an aperture for receiving a part of the rotatable slot lock there through, the rotatable slot lock being slidable along the length of the aperture about a circular path;

wherein the slot lock is operationally configured to dictate pivot action of the load bearing member from a fully closed position to a fully open position; and, wherein the link assembly includes a first link pivotally attached to the shank member at a first pivot point and pivotally attached to a second link at a second pivot point, the second link being pivotally attached to the load bearing member at a first pivot point and pivotally attached to the first link at a second pivot point.

10. The hook assembly of claim 9 wherein the second link is operationally configured to received a lanyard there through.

11. The hook assembly of claim 9 wherein the second link includes a raised surface having an edge correlating in shape to the outer surface of the load bearing member.

* * * * *